US005251899A

United States Patent [19]

Reed

[11] Patent Number: 5,251,899

[45] Date of Patent: Oct. 12, 1993

[54] METHOD OF RESTORING GAME PIECES IN MULTI-CHANNEL GAME PUZZLE

[76] Inventor: Brian Reed, 8 Carlos Dr., Berkley, Mass. 02779

[21] Appl. No.: 901,371

[22] Filed: Jul. 28, 1992

Related U.S. Application Data

[62] Division of Ser. No. 667,032, Mar. 29, 1991.

[51] Int. Cl.[5] ..... A63F 9/12

[52] U.S. Cl. ..... 273/153 S; 273/109

[58] Field of Search ..... 273/153 R, 153 S, 155, 273/109, 110, 113

[56] References Cited

U.S. PATENT DOCUMENTS

| | | | |
|---|---|---|---|
| 743,605 | 11/1993 | Wilson | 273/153 R |
| 4,957,291 | 9/1990 | Miffitt et al. | 273/153 R |

FOREIGN PATENT DOCUMENTS

| | | | |
|---|---|---|---|
| 1263266 | 10/1986 | U.S.S.R. | 273/153 S |
| 1296193 | 3/1987 | U.S.S.R. | 273/153 S |
| 1514391 | 10/1989 | U.S.S.R. | 273/153 S |
| 2086240 | 5/1982 | United Kingdom | 273/153 S |

*Primary Examiner*—V. Millin

*Assistant Examiner*—William M. Pierce

*Attorney, Agent, or Firm*—Thomas A. Kahrl

[57] ABSTRACT

A multi-channel game puzzle and method of play utilizing manual tilting employing the multi-channel game puzzle. The game puzzle including a housing defining a main chamber and having a vertical axis further including a plurality of channels positioned in a common plane within the main chamber being equally spaced and extending radially outward, a central chamber having swivel means mounted on a plurality of pivot pins for rotatably mounting the central chamber within the main chamber about the common vertical axis for permitting free swiveling of the inner chamber relative to the housing upon manual tilting of the housing between a first communication position, a second communication position, a third communication position and a fourth communication position and including a plurality of sets of game pieces each set having like marked game pieces also including a unitary blocker piece having distinctive marking characteristics wherein the outer surface of the housing is manually grasped by a player to play by tilting to urge the game pieces from one channel to another and to rotate the central chamber relative to the housing for accepting and discharging player pieces for rearrangement of the sequence.

1 Claim, 3 Drawing Sheets

METHOD OF RESTORING GAME PIECES IN MULTI-CHANNEL GAME PUZZLE

This is a divisional of copending application Ser. No. 07/667,032, filed on Nov. 7, 1991 and International application 92/01783 filed on Nov. 6, 1992 and which designated the U.S.

BACKGROUND OF THE INVENTION

In the past, mechanically operated, hand-held puzzles have been found to be popular in that such puzzles seek to challenge a player's ability to solve problems while exercising memory recall and at the same time testing his or her physical dexterity.

Certain games and puzzles are known in the art including puzzles in which the playing pieces are connected in a manner permitting only prescribed motions relative to each other, such pieces being initially randomly scrambled, with the object being to unscramble the game pieces. In the unscrambled orientation, the pieces are placed in a recognized series or order. By changing the orientation of the pieces, they become scrambled and the object of the game involved is an unscrambling operation requiring movement of the game pieces relative to one another, the sequence and types of movements varying in character and difficulty. One such game puzzle is the so-called RUBICS CUBE device as is shown in U.S. Pat. No. 3,655,201 (Nichols). In that puzzle the object is to rearrange the colors of the faces of the game pieces by rotation of groups of nine pieces at a time. All of such nine pieces occupying a given row or column of the cube.

It is desirable to provide for a new and improved multi-channel game puzzle which involves manual dexterity, memory recall and problem solving capabilities of a player when rearranging the positions of a series of mobile player pieces contained within multiple channels forming passageways interconnected by a central chamber wherein, the player causes rearrangement of the player pieces by manually tilting the game device such that the game pieces are urged from one channel to another via the central chamber to achieve the specified arrangement as a goal.

SUMMARY OF THE INVENTION

The invention relates to a game puzzle apparatus including a plurality of sets of game pieces which utilizes tilting by a player to realign the player pieces in a preselected order. In particular, the invention concerns a multi-channel game puzzle wherein multiple player pieces are positioned in a scrambled order in multiple channels contained within a hollow housing constructed of transparent material connected by a centrally positioned chamber, having an internal passageway, the player pieces being moved responsive to hand-held tilting and rotation in an effort to realign the player pieces in a preselected unscrambled order.

In the preferred embodiment the game puzzle apparatus contains a housing constructed of a clear spherical shaped housing and includes a series of five channels of tubular construction, also of transparent material equally spaced about the center of the spherical housing an extending radially outward in a common plane from a centrally located central chamber pivotably mounted on the vertical axis of the housing with each channel constructed to contain a plurality, preferably five player pieces. The player pieces consist of multiple sets, preferably five in number of differently marked playing pieces, preferably playing balls, with each set having four like marked pieces. The spherical housing also contains a single flat surface adapted to facilitate placing the housing on a flat surface to provide a pause in the tilting of the puzzle solving process providing a stable surface for storing the device in between play.

Furthermore, an additional single blocker piece, preferably a ball, having marking characteristics distinct from those found on playing balls, is present to add to the difficulty of the puzzle and solution. The object of the solution is to combine all like marked balls into a preselected channel, preferably a total of four balls in each channel, the channels being constructed as to be slightly larger in diameter than the playing balls and designed to accept any combination of up to five balls at any one time. The channels are affixed to the clear spherical housing and at the outer end and each contain at the outermost point an annular opening adapted to receive removable plugs for the express purpose of providing access for removing the balls in order to reset the puzzle by inserting and mixing the player balls prior to commencing play.

The central chamber is mounted at the axis at the very core of the clear spherical housing, the sphere being a non clear solid colored chamber containing two cavities large enough to accept any one of the playing balls and/or blocker ball and obscuring them from the player's view. The radial location of the cavities relative to one another is the radial distance between the channels. Also provided is a pair of swivel journals extending inwardly from the housing and pin means for providing free rotation of the central chamber about an axis defined perpendicular to the plane of the channels about a common axis within the five equally spaced channels containing the playing balls and a single blocker ball. This rotation motion is necessary for the transportation of balls from one channel to the next.

METHOD OF PLAY

The game puzzle consists of an outer clear spherical housing in which internally affixed about the center is a group of five equally spaced radially extending channels. Restrained within the channels are five sets of differently marked playing balls with each set having four like marked balls. For the purpose of explanation it is assumed that these playing balls are differentiated by color and therefore exists a set of five playing balls with the following characteristics: four red playing balls, four green playing plays, four yellow playing balls, four blue playing balls and four purple playing balls.

In addition to the above there is present one blocker ball which for the purpose of explanation is colored black.

Finally the puzzle is completed by the presence of a central chamber internally mounted in such a way as to allow rotation freedom about a fixed axis in both directions. Also provided within this inner sphere is two cavities located opposite in spaced apart relationship to one another and in horizontal alignment with the five equally spaced channels containing the colored playing balls and large enough to accept the presence of any one of the player balls or blocker ball.

Play begins when the five equally spaced channels are filled with different colored balls. The object of the puzzle is to relocate the colored balls in such a way that each equally spaced channel contains only those balls of the same color. This is accomplished by tilting the puzzle and allowing a player ball or blocker ball to evacuate a particular channel and enter one of the cavities provided within the central chamber.

Because the balls are weighted, this imbalance to concentricity will cause the central chamber to rotate. The player must then align the cavity which carries the ball in play in proximity to the channel in which he or she wishes the ball to reside. By tilting the central chamber toward the intended channel the ball in play will exit the central chamber and reposition itself inside the preselected channel. In addition, and occur ring concurrent with this event, the cavity opposite and opposing the cavity carrying the ball in play will begin to accept the new ball. The player must take notice of what color ball is entering the cavity since once seated in the cavity of the central chamber it will no longer be visible to the player. This process is repeated until such time that all the like colored balls are residing in a common separate channel to be stored. At any time during the game, play can be paused by simply placing the puzzle on a flat area provided on the housing on any flat surface such as a desk or table. To reset the puzzle one must remove the retaining plugs provided in each channel and evacuate the balls. The player balls can then be scrambled according to color and reinstalled into the five channels placing four differently colored balls in each channel. Replacing the retaining plugs into the five channels complete the puzzle reset process and the game is now ready for play. Although the aforementioned preferred embodiment refers to a spherical outer housing fitted with a flat surface area for stability of storage, the device's outer skin could be provided in a cubic or pyramid shaped configuration. The internal components would only have to be altered to accommodate the new outer geometry but could otherwise remain functionally the same.

Finally the player balls and the blocker ball have been described as spherical in shape and the channels in tubular arrangement the diameter of which is slightly larger than those of the balls. The design could be altered such that the player balls and the blocker ball could be of a different geometry, the channels taking on a complimentary configuration; an example of which might be a smaller square cubes of different colors or markings sliding in slightly larger square track.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
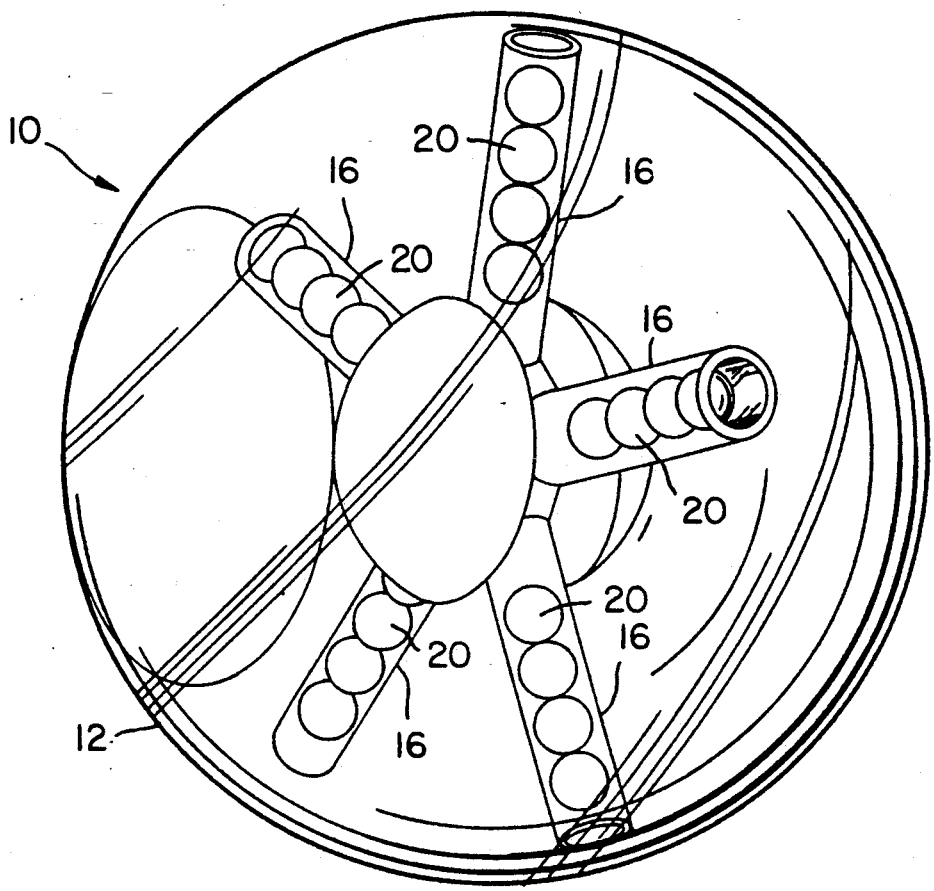
FIG. 1 is an isometric view of one embodiment of the present invention in a three dimensional form.
Figure 2:
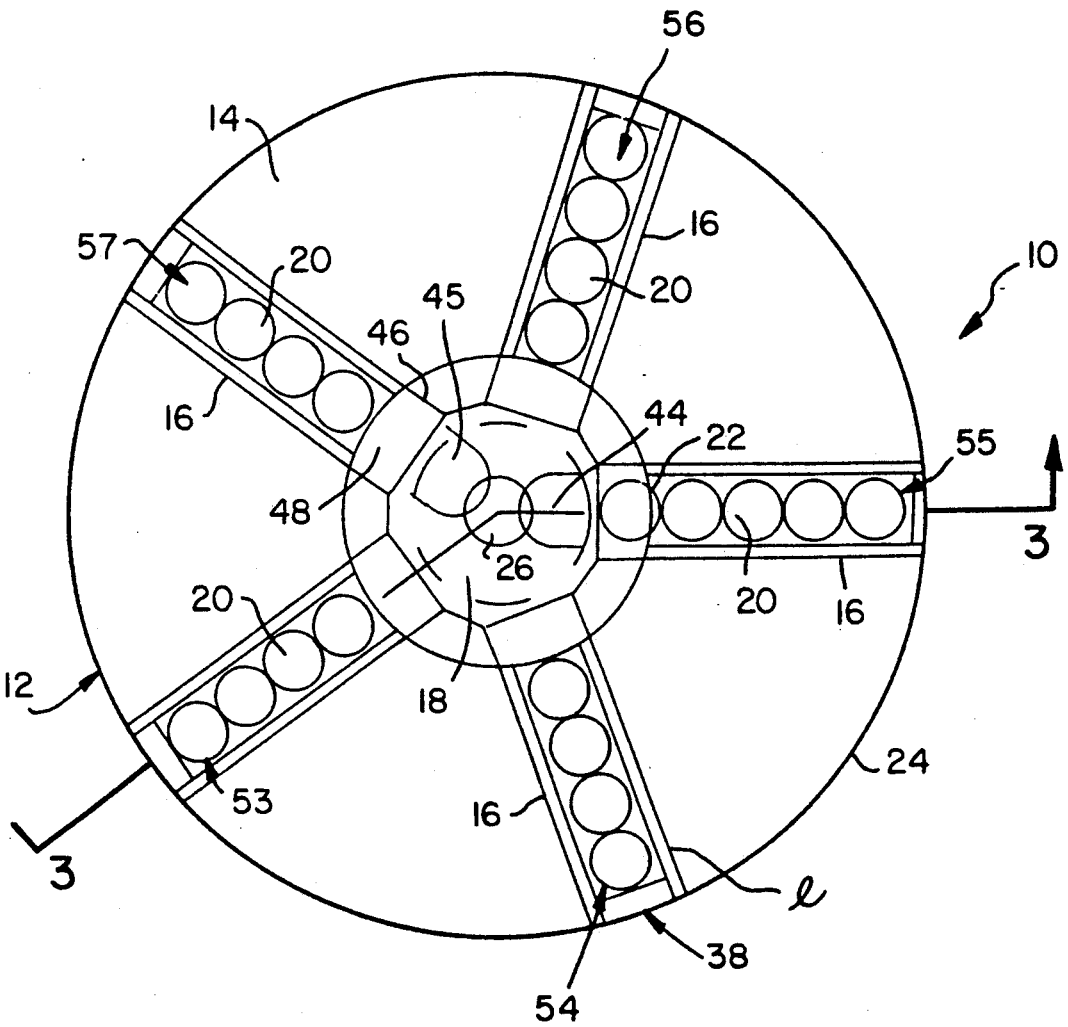
FIG. 2 is a top plan view of the present invention.
Figure 3:
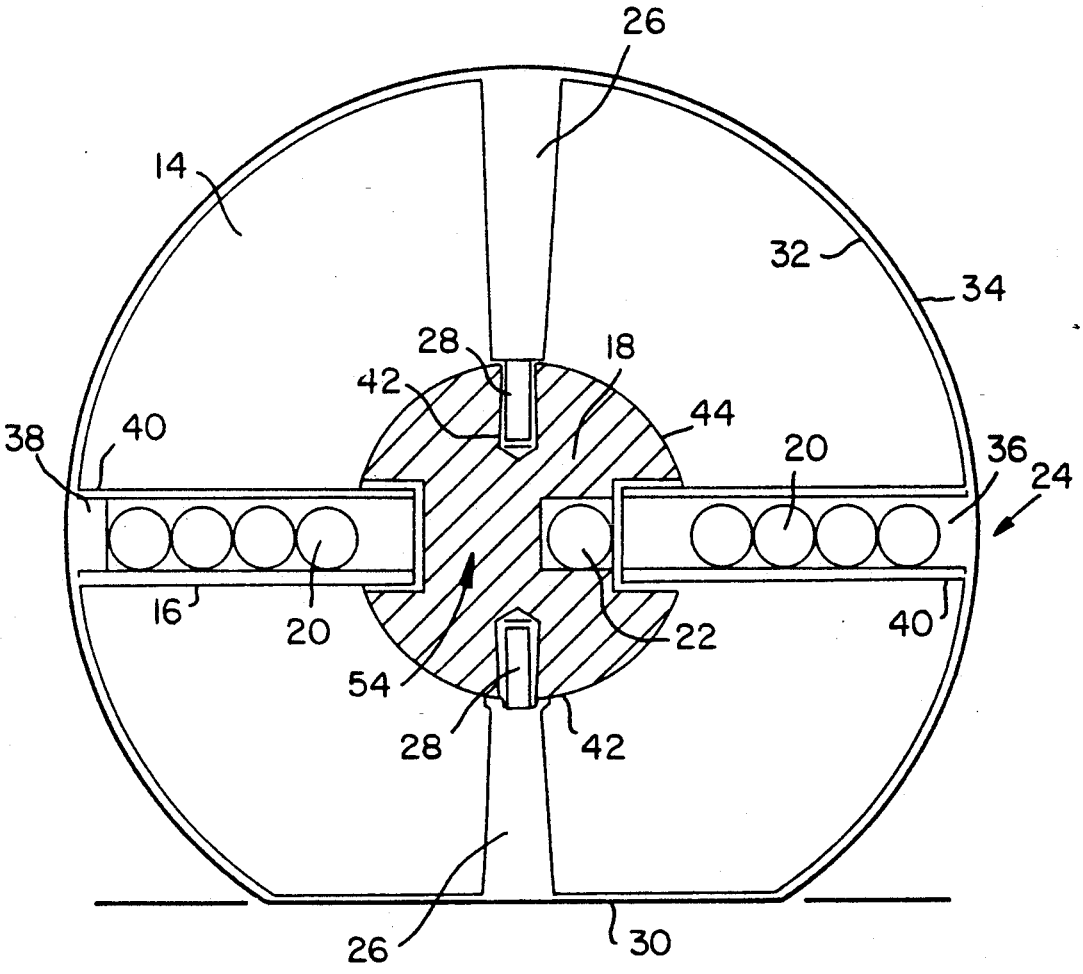
FIG. 3 is a sectional view of the present invention taken along lines 3—3 of FIG. 2.

With reference to the drawings, in FIG. 1 there is shown and illustrated a game puzzle 10 of the invention which includes a housing 12 defining a main chamber 14 containing a plurality of tubular channels 16 centrally connected to a pivotably mounted central chamber 18, said channels containing five sets of game pieces 20 and a unitary blocker piece 22. As shown in FIGS. 1, 2 and 3, the housing 12 is provided with a spherical shell member 24 adapted to be hand held, a pair of spaced-apart swivel journals 26 mounted along the vertical axis of the housing, each swivel journal having an inwardly extending pivot pin zs and includes a flat exterior surface 30 which is coplanar with the axis of the plane of the channels the housing being constructed typically of transparent material and having a vertical and horizontal axis and includes an inner surface 32 and an outer surface 34 and a plurality, typically five equally spaced annular members 36 positioned on the horizontal axis of the housing being equally spaced to permit entrance and exit of game pieces 20 with respect to the five channels 16. Said annular members being positioned on the circumference of the housing at the inner section of the horizontal axis therewith, the annular members having a diameter greater than the diameter of the player pieces 20. There is also provided a plurality of closure plugs 38, typically five in number, for providing closure devices for the annular members 36 for enclosing game pieces 20 within the housing during the course of play.

Mounted in the main chamber 14 are a plurality of channels 16, typically five in number of hollow tubular construction in equally spaced relation, extending radially outward from the vertical axis of the housing 12 and intersecting said housing along the horizontal axis of the housing wherein the outer end 40 of the channel 16 are in communication with the annular members 36 which are adapted to removably receive the closure plugs 38. The closure plugs may be manually removed selectively at the option of the player for rearranging the game pieces 20.

As shown in FIGS. 2 and 3, there is positioned at the center of the main chamber 14 a central chamber 18, typically of spherical construction being pivotably mounted on a pair of pivot pins 28 extending outwardly from swivel journals 26 and received by swivel openings 42 which are spaced-apart and positioned along the central vertical axis of the central chamber 18 for providing free rotation of the central chamber 18 relative to the housing 12 about the vertical axis. The central chamber 14 is characterized by two cavities 44 and 45, is typically of spherical construction having a circumferential recess 46 for accepting the inner ends 48 of the channels 16 being positioned in coplanar relationship therewith. The two cavities 44 and 45 are constructed to accept any one of the game pieces 20 including a playing ball 50 or a blocker ball 52 the central chamber 14 has an opaque outer surface 54 for obscuring the players view of the inner contained balls 20 positioned within cavities 44 and 45. The cavities 44 and 45 are in spaced relationship, the spacing being the radial distance between the channels 16. The game piece sets typically consists of five sets of four pieces each, the first set being shown as 53 all of one color, the second set being shown as 54 all of one color, the third set being shown as 55 all of one color, the fourth set being shown as 56 all of one color and the fifth set being shown as 57 all of one color.

What is claimed is:

1. A method of restoring game pieces in a preselected order from sets of game pieces which game pieces are contained within a clear spherical housing positioned within multiple equally spaced radially extending channels each channel constructed to contain a plurality of game pieces, the channels extending outwardly from the central pivotably mounted chamber having opaque walls comprising:

a) providing a transparent hollow sphere having a plurality of interior channels;

b) providing a central chamber having an opaque wall pivotably mounted along the vertical axis of the sphere for rotation about the axis and in communication with the interior ends of the channels;

c) providing a first set of at least two pieces each of said pieces characterized by a first color;

d) providing a second set of game pieces having at least two pieces each of said pieces characterized by a second color;

e) providing a third set of game pieces having at least two pieces each of said pieces characterized by a third color;

f) providing a fourth set of pieces having at least two pieces each of said pieces characterized by a fourth color;

g) providing a fifth set of game pieces having at least two pieces each of said pieces characterized by a fifth color;

h) providing a distinctive unitary piece characterized by the absence of color;

i) installing a plurality of pieces in the channels in a random order;

j) tilting the housing causing the rotation of the inner chamber such that the inner chamber accepts a piece into the central chamber; and k) ejecting a piece from the central chamber.

* * * * *